US010259234B2

(12) United States Patent
Baker et al.

(10) Patent No.: US 10,259,234 B2
(45) **Date of Patent: *Apr. 16, 2019**

(54) INKJET PRINTING SYSTEM HAVING DYNAMICALLY CONTROLLED INK RESERVOIR

(71) Applicant: The Boeing Company, Chicago, IL (US)

(72) Inventors: Richard J. Baker, Plainfield, NH (US); Myles S. Duncanson, Franklin, NH (US); Robert G. Palifka, Orford, NH (US); Bennett M. Moriarty, Seattle, WA (US); Shane E. Arthur, Kirkland, WA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/987,100

(22) Filed: May 23, 2018

(65) Prior Publication Data

US 2018/0361752 A1 Dec. 20, 2018

Related U.S. Application Data

(63) Continuation of application No. 15/624,351, filed on Jun. 15, 2017, now Pat. No. 10,000,065.

(51) Int. Cl.

| | |
|---|---|
| ***B41J 2/175*** | (2006.01) |
| ***B41J 2/165*** | (2006.01) |
| *B41J 2/14* | (2006.01) |

(52) U.S. Cl.

CPC ..... *B41J 2/17566* (2013.01); *B41J 2/1404* (2013.01)

(58) Field of Classification Search

CPC ..... B41J 2/165; B41J 2/175; B41J 2/17566; B41J 2/1404

See application file for complete search history.

(56) References Cited

U.S. PATENT DOCUMENTS

| | | | |
|---|---|---|---|
| 5,646,666 | A | 7/1997 | Cowger et al. |
| 5,848,859 | A | 12/1998 | Clark et al. |

(Continued)

FOREIGN PATENT DOCUMENTS

| | | | |
|---|---|---|---|
| EP | 20180970 | A | 1/2009 |
| JP | 2003300332 | A | 10/2003 |

OTHER PUBLICATIONS

European Search Report related to Application No. EP 18177246 dated Oct. 26, 2018.

*Primary Examiner* — Thinh H Nguyen

(74) *Attorney, Agent, or Firm* — Miller, Matthias & Hull LLP

(57) ABSTRACT

An inkjet printing system includes an ink reservoir defining an ink-receiving chamber and a control chamber, a control fluid source fluidly communicating with the control chamber, and an orientation sensor configured to determine an orientation of the ink reservoir and generate an orientation signal. A processor is operably coupled to the control fluid source and the orientation sensor, the processor programmed to determine a desired pressure for the control chamber based, at least in part, on the orientation signal, and control the control fluid source to adjust an actual pressure level in the control chamber to the desired pressure for the control chamber.

20 Claims, 7 Drawing Sheets

(56) References Cited

U.S. PATENT DOCUMENTS

| | | | | |
|---|---|---|---|---|
| 7,467,858 | B2 | 12/2008 | Lebron et al. | |
| 8,192,000 | B2 * | 6/2012 | Coffey | B41J 2/175 347/85 |
| 2005/0285886 | A1 | 12/2005 | Okamoto | |
| 2008/0074468 | A1 | 3/2008 | Silverbrook | |
| 2008/0198207 | A1 | 8/2008 | Katada | |
| 2008/0231650 | A1 | 9/2008 | Kojima et al. | |
| 2016/0009007 | A1 | 1/2016 | Araki et al. | |

* cited by examiner

INKJET PRINTING SYSTEM HAVING DYNAMICALLY CONTROLLED INK RESERVOIR

FIELD

The present disclosure generally relates to inkjet printing and, more particularly, to controlling pressure of ink held in an ink reservoir used during inkjet printing.

BACKGROUND

Drop on demand printing systems typically maintain a slight backpressure within the printhead to retain ink at a desired meniscus level within a nozzle. The backpressure should be high enough to prevent ink from leaking from the nozzle when the system is not actively ejecting ink, but not so high that air is drawn into the printhead through the nozzle. In conventional systems, the backpressure is typically set at a static pressure level. In some systems, multiple static pressure levels may be provided based on the type of printing mode being used. Systems that provide one or more static pressure levels, however, do not adequately manage backpressure in inkjet systems that are configured to print on complex, three-dimensional surfaces, where backpressure requirements may change as the printhead is placed at different attitudes relative to the surface to be printed.

SUMMARY

In accordance with one aspect of the present disclosure, a controller is provided for dynamically controlling pressure in an ink reservoir of an inkjet assembly having an ink reservoir defining an ink-receiving chamber and a control chamber for receiving a control fluid from a control fluid source, and an orientation sensor configured to determine an orientation of the ink reservoir and generate an orientation signal. The controller comprises a processor operably coupled to the control fluid source and the orientation sensor, the processor programmed to determine a desired pressure for the control chamber based, at least in part, on the orientation signal, and control the control fluid source to adjust an actual pressure level in the control chamber to the desired pressure for the control chamber.

In accordance with another aspect of the present disclosure, an inkjet printing system includes an ink reservoir defining an ink-receiving chamber and a control chamber, a control fluid source fluidly communicating with the control chamber, and an orientation sensor configured to determine an orientation of the ink reservoir and generate an orientation signal. A processor is operably coupled to the control fluid source and the orientation sensor, the processor programmed to determine a desired pressure for the control chamber based, at least in part, on the orientation signal, and control the control fluid source to adjust an actual pressure level in the control chamber to the desired pressure for the control chamber.

In accordance with a further aspect of the present disclosure, an inkjet printing system having a dynamically controlled ink backpressure includes a frame supported for rotation in at least one degree of freedom relative to a vertical reference axis, an ink reservoir coupled to the frame and defining a longitudinal axis and comprising a control chamber and an ink-receiving chamber, a control fluid source fluidly communicating with the control chamber to deliver a control fluid across a range of pressure levels, and an orientation sensor for determining an orientation of the ink reservoir and generating an orientation signal. A processor is operably coupled to the control fluid source and the orientation sensor, the processor programmed to determine a desired pressure for the control chamber based, at least in part, on the orientation signal, and control the control fluid source to adjust an actual pressure level in the control chamber to the desired pressure for the control chamber.

The features, functions, and advantages that have been discussed can be achieved independently in various embodiments or may be combined in yet other embodiments further details of which can be seen with reference to the following description and drawings.

It should be understood that the drawings are not necessarily drawn to scale and that the disclosed embodiments are sometimes illustrated schematically. It is to be further appreciated that the following detailed description is merely exemplary in nature and is not intended to limit the invention or the application and uses thereof. Hence, although the present disclosure is, for convenience of explanation, depicted and described as certain illustrative embodiments, it will be appreciated that it can be implemented in various other types of embodiments and in various other systems and environments.

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 5:
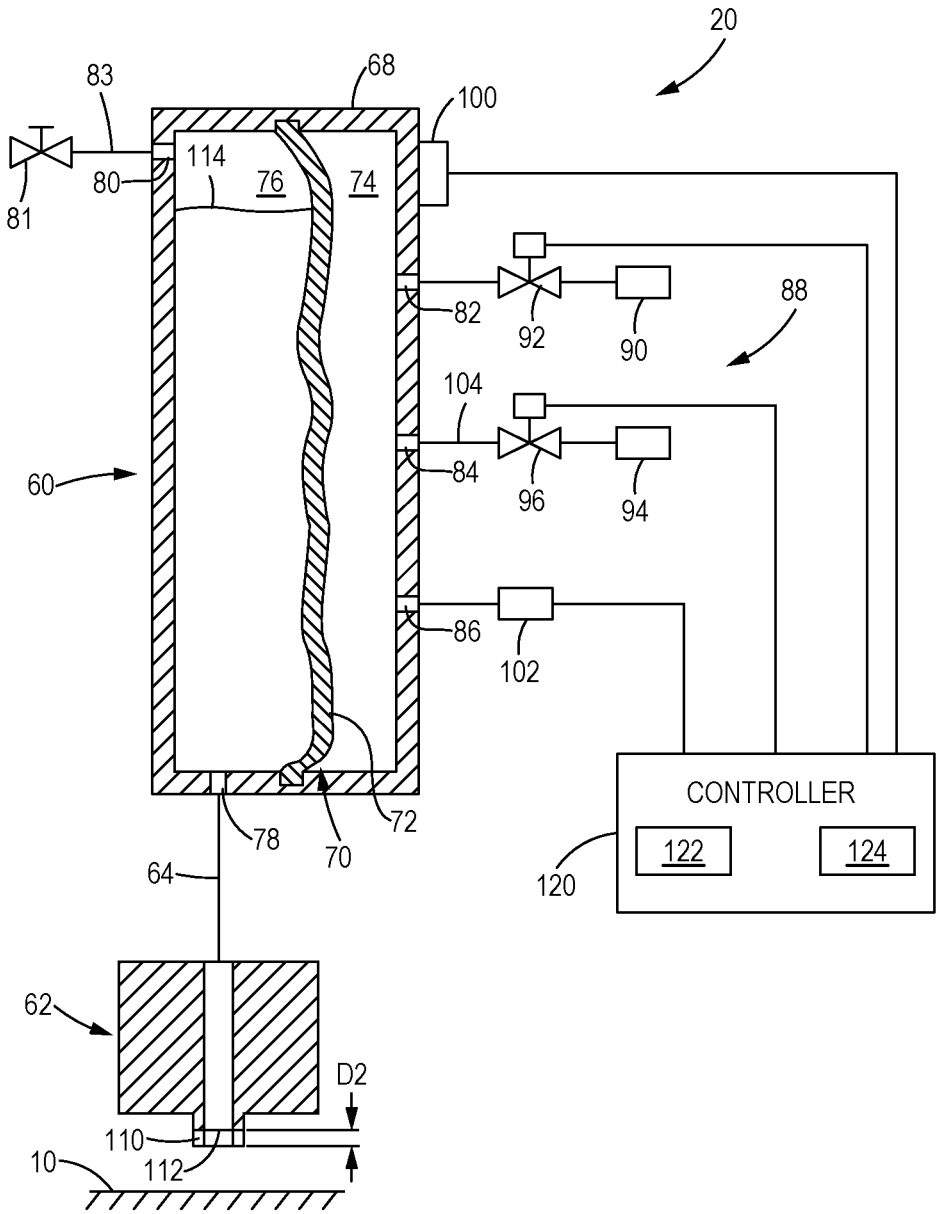
FIG. 5 is a partially schematic illustration of the inkjet assembly of FIGS. 3 and 4.

Inkjet printing systems and methods are disclosed herein that are particularly suited for printing on complex, three dimensional surfaces, such as a surface 10 of an aircraft (FIG. 5). More specifically, the systems and methods disclosed herein dynamically manage pressure in an ink reservoir based on an orientation of a printhead. As a result, a level of a meniscus in a nozzle of the printhead is maintained, regardless of an orientation of the printhead.

Figure 1:
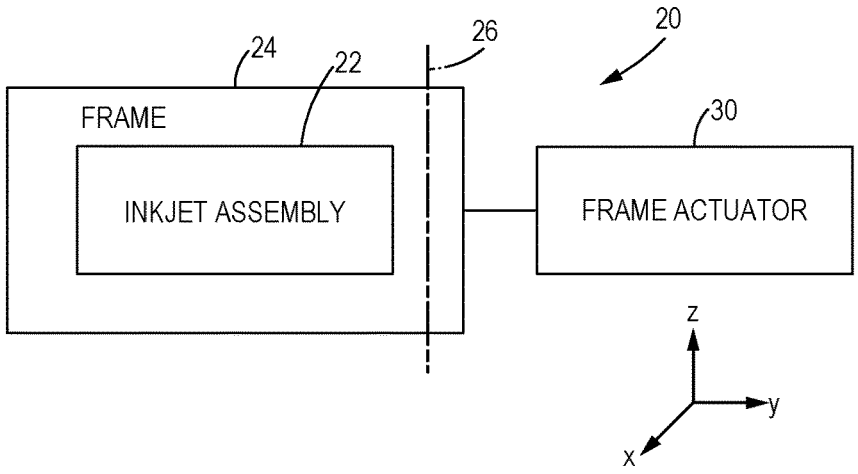
FIG. 1 is a schematic block diagram of an inkjet printing system according to the present disclosure.

More specifically with reference to FIG. 1, an inkjet printing system 20 includes an inkjet assembly 22 coupled to a frame 24. The frame 24 is supported for rotation in at least one degree of freedom relative to a vertical reference axis 26. In some embodiments, the frame is supported for rotation in three degrees of freedom, such as about orthogonal X, Y, and Z axes, and the vertical reference axis 26 may be parallel to the Z axis as illustrated in FIG. 1.

Figure 2:
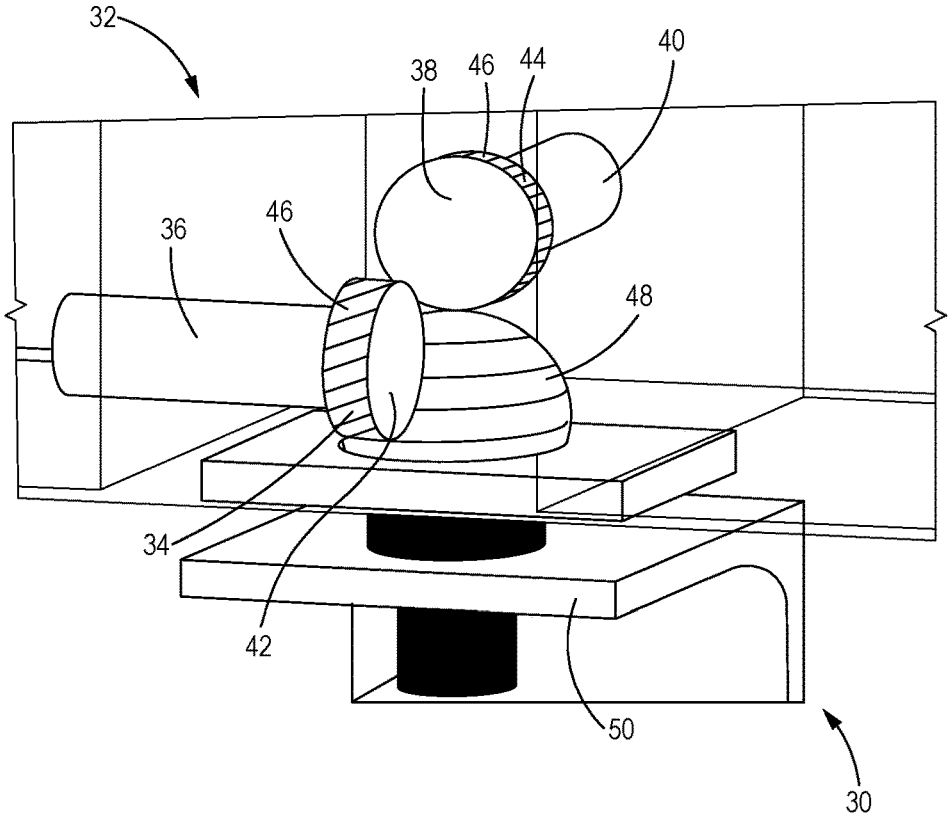
FIG. 2 is an enlarged perspective view of an exemplary actuator used in the inkjet printing system of FIG. 1.

The inkjet printing system 20 may further include a frame actuator 30 for actuating the frame 24 in the at least one degree of freedom relative to the vertical reference axis 26. For example, the exemplary frame actuator 30 illustrated at FIG. 2 operates to rotate the frame 24 about the X, Y, and Z axes. In this embodiment, the frame actuator 30 includes a micro-wheel actuation device 32 having multiple micro-actuation elements. For example, the micro-wheel actuation device 32 includes a first micro-wheel 34 rotatably coupled to a first electric motor 36, and a second micro-wheel 38 rotatably coupled to a second electric motor 40. The first and second electric motors 36, 40 independently drive the first and second micro-wheels 34, 38, respectively. It will be understood, however, that a fewer or greater number of micro-wheels and electric motors can be incorporated into the micro-wheel actuation device 32 as needed. In some embodiments, a circumference of the first micro-wheel 34 has a first wheel surface 42, and a circumference of the second micro-wheel 38 has a second wheel surface 44. Additionally, each of the first and second wheel surfaces 42, 44 include a wheel micro-texture 46 that engages with a micro-texturing on the surface of a gimbal 48. The frame 24 may include a frame base 50 that pivots and/or rotates about the gimbal 48, so that operating the first and second electric motors 36, 40, sequentially or simultaneously, will pivot the frame 24. While the frame actuator 30 is shown as a gimbal-style actuator in FIG. 2, it will be appreciated that other types of frame actuators, such as gear driven or robotic arms, may be used without departing from the scope of the appended claims. Additionally, while the illustrated frame actuator 30 provides movement in three axes, it will be appreciated that the frame actuator may be capable of movement in greater than or less than three axes.

Figure 3:
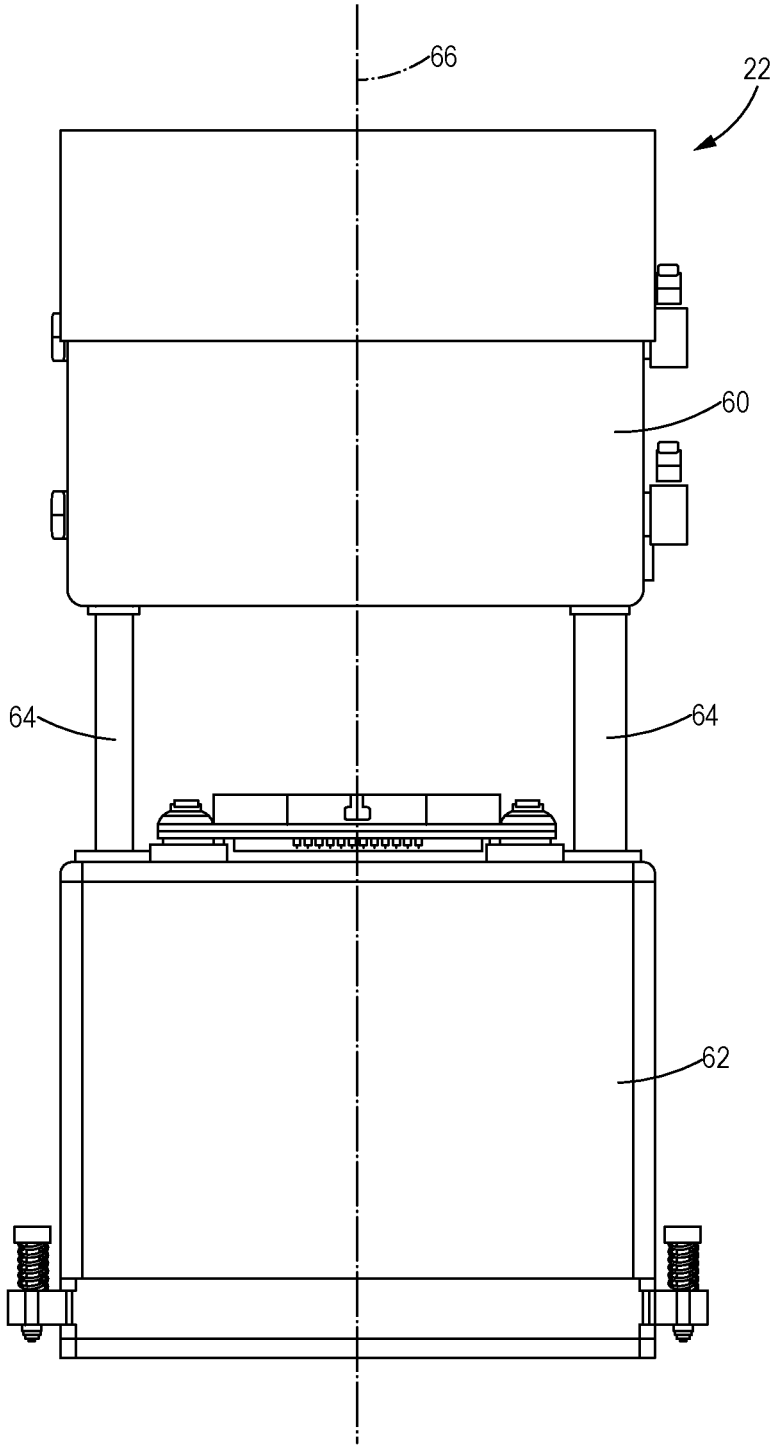
FIG. 3 is a front elevation view of an inkjet assembly used in the inkjet printing system of FIG. 1.
Figure 4:
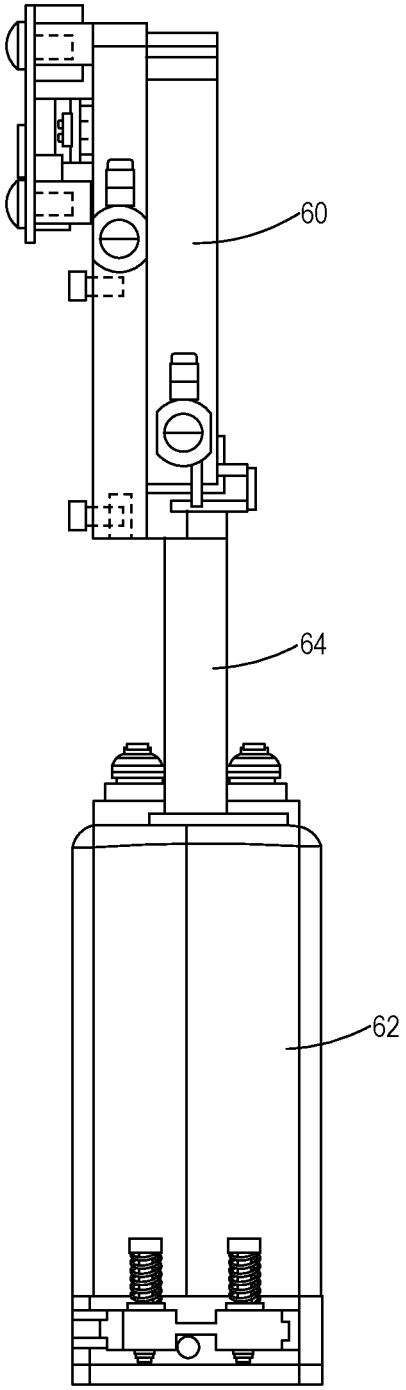
FIG. 4 is a side elevation view of the inkjet assembly of FIG. 3.

The inkjet assembly 22 is coupled to, and pivotable with, the frame 24. As best shown with reference to FIGS. 3-5, the inkjet assembly 22 generally includes an ink reservoir 60 for holding ink, and a printhead 62 for depositing ink onto the surface 10 to be printed. The ink reservoir 60 may fluidly communicate with the printhead through supply conduits 64. While two supply conduits 64 are shown, a fewer or greater number of supply conduits 64 may be provided as needed. Additionally, the ink reservoir 60 extends along a longitudinal axis 66.

As best shown in FIG. 5, the ink reservoir 60 includes a housing 68 defining an interior chamber 70. A flexible membrane 72 is disposed in the housing 68 and divides the interior chamber 70 into a control chamber 74 and an ink-receiving chamber 76. The flexible membrane 72 accommodates changing volumes of the control chamber 74 and ink-receiving chamber 76. In certain embodiments, the flexible membrane 72 is configured so that it can change shapes without exerting a reactive force or pressure against the fluid in the ink-receiving chamber 76. While the flexible membrane 72 is illustrated in FIG. 5 as being substantially planar, it will be appreciated that the flexible membrane 72 may be formed in other shapes, such as a frusto-conical or bag shape. The housing 68 further defines an ink outlet port 78, an ink refill port 80, a first pressure supply port 82, a second pressure supply port 84, and a pressure sensing port 86. An ink refill valve 81 may be provided in an ink refill line 83 fluidly communicating with the ink refill port 80.

A control fluid is supplied to the control chamber 74 to control a pressure of the ink disposed in the ink-receiving chamber 76. With continued reference to FIG. 5, a control fluid source 88 fluidly communicates with the control chamber 74 to deliver the control fluid across a range of pressure levels. In the illustrated embodiment, the control fluid source 88 includes a positive pressure source 90 fluidly communicating with the control chamber 74 through a first valve 92 to the first pressure supply port 82 to supply control fluid at a positive pressure (i.e., above an ambient pressure present outside of the housing 68). The control fluid source 88 further includes a negative pressure source 94 fluidly communicating with the control chamber 74 through a second valve 96 to the second pressure supply port 84, to supply control fluid at a negative pressure (i.e., below an ambient pressure present outside of the housing 68). By selectively opening the first valve 92 and the second valve 96, a desired pressure of control fluid is provided to the control chamber 74 which is then applied, via the flexible membrane 72, to the ink in the ink-receiving chamber 76. An exemplary control fluid is air, however other fluids may be used.

Additionally, an orientation sensor 100 is provided for determining an orientation of the inkjet assembly 22. In the exemplary embodiment shown in FIG. 5, the orientation sensor 100 is an accelerometer coupled to the housing 68 of the ink reservoir 60. Accordingly, the accelerometer may determine an orientation of a reference associated with the ink reservoir 60, such as the longitudinal axis 66 of the ink reservoir 60, relative to a fixed reference frame, such as the vertical reference axis 26. In this embodiment, the orientation sensor 100 generates an orientation signal indicative of an angle between the longitudinal axis 66 of the ink reservoir 60 and the vertical reference axis 26.

The inkjet assembly 22 further includes a pressure sensor 102 for determining an actual pressure level in the control chamber 74. As best shown in FIG. 5, the pressure sensor 102 may be disposed in a pressure sensor line 104 that fluidly communicates with the pressure sensing port 86. The pressure sensor 102 generates a pressure signal indicative of the actual pressure level in the control chamber 74.

Figure 6:
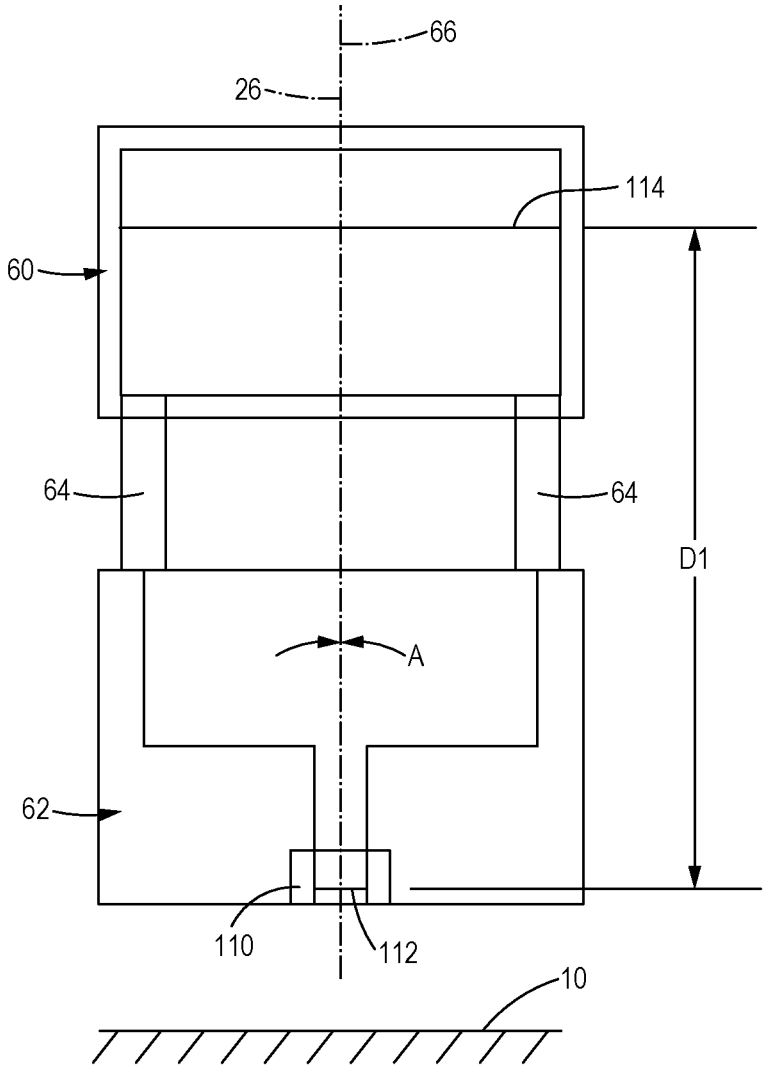
FIG. 6 is a schematic, front, plan view, in cross-section, of the inkjet assembly of FIGS. 3-5, in a vertical position.

The printhead 62 receives ink from the ink reservoir 60 and selectively discharges ink droplets onto the surface 10. As best shown in FIGS. 5 and 6, the printhead 62 defines a nozzle 110, in fluid communication via the supply conduits 64 and ink outlet port 78 with the ink-receiving chamber 76, from which ink droplets are discharged. The nozzle 110 defines a desired meniscus level 112 that facilitates the accurate discharge of ink droplets. The desired meniscus level 112 has a position that is fixed relative to the ink reservoir 60. More specifically, when the ink reservoir 60 is filled with ink, ink disposed in the ink-receiving chamber 76 defines an ink top surface level 114, and the desired meniscus level 112 of the nozzle 110 is spaced from the ink top surface level 114 along the longitudinal axis 66 of the ink reservoir 60 by a distance D1. The desired meniscus level 112 may also be defined by a distance D2 relative to a tip 109 of the nozzle 110. For example, as shown in FIG. 5, the distance D2 may be approximately 10 microns.

The inkjet assembly 22 also includes a controller 120 for controlling operation of the inkjet assembly. More specifically, the controller includes a processor 122 that may execute logic stored in data storage 124 to control the operations. The controller 120 is operably coupled to the first valve 92, the second valve 96, the orientation sensor 100, and the pressure sensor 102. The controller 120 may be representative of any kind of computing device or controller, or may be a portion of another apparatus as well, such as an apparatus included entirely within a server and portions of the controller 120 may be elsewhere or located within other computing devices.

The processor 122 is programmed to dynamically control pressure in the control chamber 74 based on orientation of the ink reservoir 60. More specifically, the processor 122 may be programmed to infer an angle A of the longitudinal axis 66 relative to the vertical reference axis 26 based on the orientation signal from the orientation sensor 100.

Additionally, the processor 122 is programmed to calculate an effective water column height along the vertical reference axis 26 based on the inferred angle A of the longitudinal axis 66 of the ink reservoir 60 and the distance D1 between the desired meniscus level 112 of the nozzle 110 and the ink top surface level 114. With the distance D1 being predetermined and substantially fixed, and the angle of the longitudinal axis 66 being determined from the orientation sensor 100, the effective water column may be calculated using simple trigonometry.

The processor 122 further may be programmed to determine a desired pressure for the control chamber 74 based, at least in part, on the effective water column height H. The effective water column height H may be directly converted into a pressure value, such as inches of water column, that may be used to determine how much backpressure is needed to maintain ink at the desired meniscus level 112. More specifically, the desired pressure for the control chamber 74 must take into account the pressure equivalent to the effective water column height H to maintain a predetermined pressure at the meniscus. Stated mathematically, the predetermined pressure at the meniscus $P_M$ is equal to the sum of the desired pressure for the control chamber $P_C$ and the effective water column pressure $P_{EWC}$. The desired pressure for the control chamber $P_C$ depends on several factors, but is primarily related to the distance between the ink reservoir 60 and the printhead 62. For systems used to print on aircraft, for example, the desired pressure for the control chamber $P_C$ is expected to be within a range of approximately +10 inches water column to −10 inches water column. The predetermined pressure at the meniscus $P_M$ is selected to have a value that holds the ink at the desired meniscus level 112. For example, the predetermined pressure at the meniscus $P_M$ may be within a range of approximately +0.5 inches water column to approximately −0.5 inches water column.

Additionally, the above equation may be rearranged to solve for the desired pressure for the control chamber $P_C$, wherein desired pressure for the control chamber $P_C$ is equal to the predetermined pressure at the meniscus $P_M$ minus the effective water column pressure $P_{EWC}$. For example, if the predetermined pressure at the meniscus $P_M$ is negative 0.25 inches water column, and the effective water column height H is 2 inches (and therefore the effective water column pressure $P_{EWC}$ is 2 inches water column), then the desired pressure for the control chamber $P_C$ is negative 2.25 inches water column.

Figure 7:
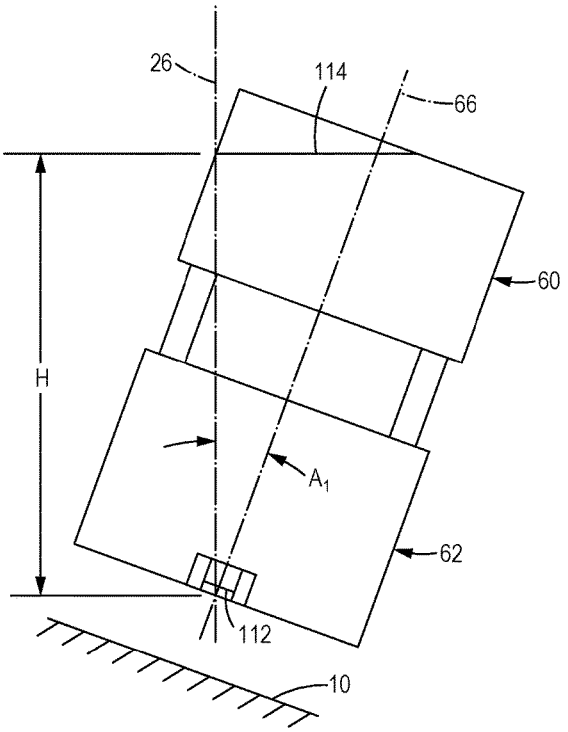
FIG. 7 is a schematic, front, plan view, in cross-section, of the inkjet assembly of FIGS. 3-6 in a first rotated position.

It will be appreciated that the effective water column pressure $P_{EWC}$ will change according to the orientation of the ink reservoir 60. More specifically, the cosine of angle A is equal to the effective water column height divided by the distance D1. Stated another way, the effective water column height is equal to the product of the distance D1 and the cosine of angle A. Thus, when the ink reservoir 60 is oriented so that the longitudinal axis 66 is vertical, the angle A is zero and the cosine of zero is 1, and therefore the effective water column pressure $P_{EWC}$ is equal to the distance D1. When the ink reservoir 60 is rotated to an angle A1, as shown in FIG. 7, then the effective water column pressure $P_{EWC}$ is equal to the distance D1 multiplied by the cosine of the angle A1. If the angle A1 is 20° and the distance D1 is 2 inches, for example, the effective water column height (and therefore the effective water column pressure $P_{EWC}$) is 1.88 inches water column. In this example, if the predetermined pressure at the meniscus $P_M$ is negative 0.25 inches water column, then the desired pressure for the control chamber $P_C$ is negative 2.13 inches water column.

Figure 8:
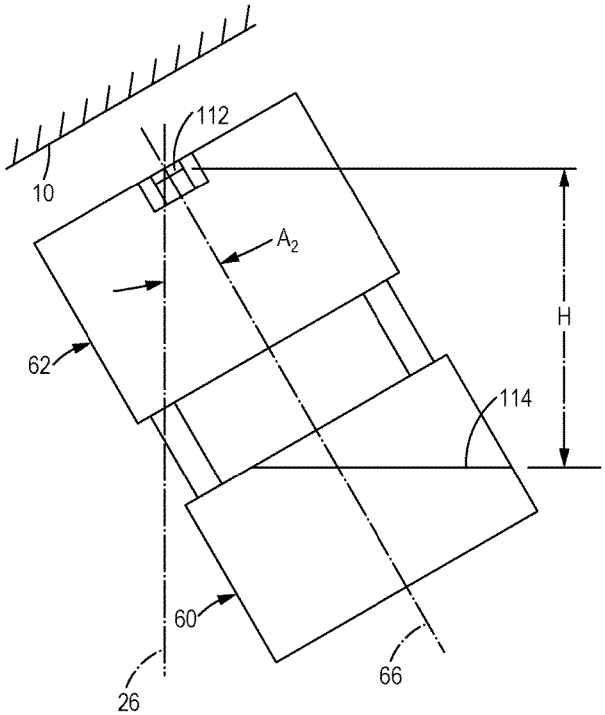
FIG. 8 is a schematic, front, plan view, in cross-section, of the inkjet assembly of FIGS. 3-7 in a second rotated position, in which a nozzle of the inkjet assembly is inverted.

Furthermore, it is noted that when the ink reservoir 60 is inverted to angle A2, as shown in FIG. 8, the effective water column height will have a negative value. According to the chamber pressure equation above, subtracting a negative value results in adding the effective water column pressure $P_{EWC}$ to the predetermined pressure at the meniscus $P_M$ to obtain the desired pressure for the control chamber $P_C$ that maintains ink at the desired meniscus level 112. For example, if the effective water column height (and therefore the effective water column pressure $P_{EWC}$ is negative 1.5 inches water column, and the predetermined pressure at the meniscus $P_M$ is negative 0.25 inches water column, then the desired pressure for the control chamber $P_C$ is positive 1.25 inches water column. Thus, the desired pressure for the control chamber $P_C$ may be positive or negative, depending on the orientation of the ink reservoir 60.

The processor 122 may further be programmed to adjust a pressure level at the control chamber 74 to achieve the desired pressure for the control chamber. More specifically, the processor 122 may operate the control fluid source 88, such as by selectively opening and closing the first valve 92 and the second valve 96, to change the pressure inside the control chamber 74. The processor may employ a simple feedback loop based on the pressure signal from the pressure sensor 102 to determine when the desired pressure for the control chamber 74 is reached.

Figure 9:
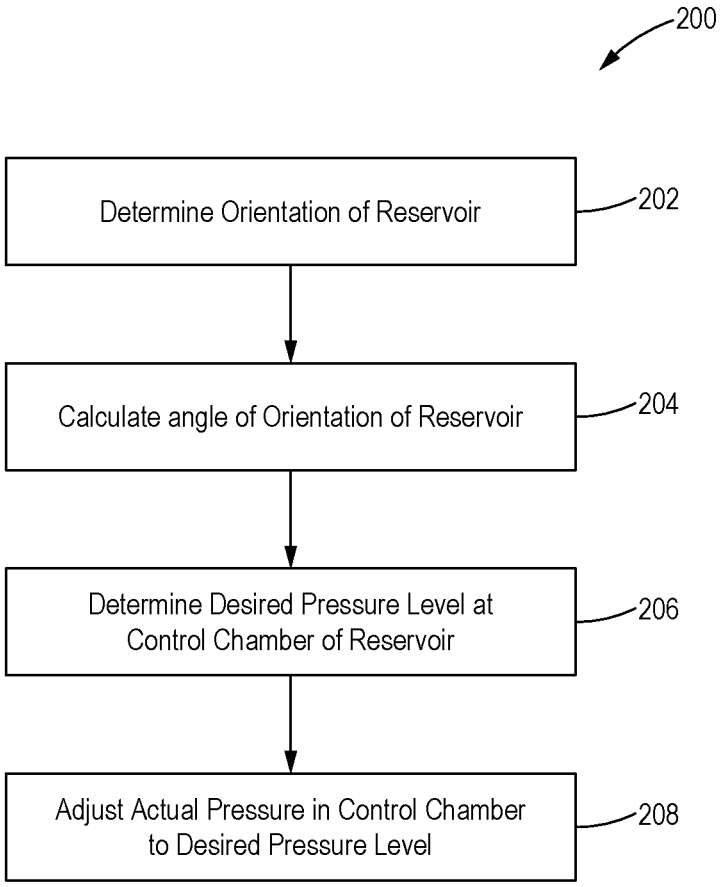
FIG. 9 is a block diagram illustrating a method of dynamically controlling backpressure in an ink reservoir of an inkjet printing system.

FIG. 9 is a flowchart illustrating an exemplary method 200 of dynamically controlling pressure in the ink reservoir 60 of an inkjet assembly 22. The method begins at block 202 by determining an orientation of longitudinal axis 66 of the ink reservoir 60 based on an orientation signal from the orientation sensor 100. At block 204, the method continues by calculating an angle A between the longitudinal axis 66 of the ink reservoir 60 and a vertical reference axis 26 based on the orientation of the ink reservoir 60 determined at block 202. At block 206, a desired pressure for a control chamber 74 of the ink reservoir 60 is determined based, at least in part, on the angle calculated at block 202. As noted above, the desired pressure for the control chamber $P_C$ may be equal to the predetermined pressure at the meniscus $P_M$ minus the effective water column pressure $P_{EWC}$. The effective water column pressure $P_{EWC}$, in turn, may be determined by calculating the effective water column height, which is equal to the product of the distance D1 and the cosine of angle A. At block 208, the method continues by controlling the control fluid source 88 to generate the desired pressure in the ink reservoir 60. For example, the control fluid source may include a positive pressure source 90 and a negative pressure source 94 that fluidly communicate with the control chamber 74 of the ink reservoir 60, and the processor 122 may selectively control the pressure sources to adjust the actual pressure of the control chamber 74 to match the desired pressure for the control chamber 74. The processor 122 may compare feedback from the pressure sensor 102 to the desired pressure for the control chamber to determine when the control chamber 74 is at the desired pressure level.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure. Various modifications, as are suited to the particular use, are contemplated.

What is claimed is:

1. A controller for dynamically controlling pressure in an ink reservoir of an inkjet assembly having an ink reservoir defining an ink-receiving chamber and a control chamber for receiving a control fluid from a control fluid source, and an orientation sensor configured to determine an orientation of the ink reservoir and generate an orientation signal, the controller comprising a processor operably coupled to the control fluid source and the orientation sensor, the processor programmed to:

determine a desired pressure for the control chamber based, at least in part, on the orientation signal; and control the control fluid source to adjust an actual pressure level in the control chamber to the desired pressure for the control chamber.

2. The controller of claim 1, in which the ink reservoir defines a longitudinal axis and the orientation sensor determines the orientation of the ink reservoir by sensing an angle of the longitudinal axis relative to a vertical reference axis, wherein the processor is programmed to determine the desired pressure for the control chamber based, at least in part, on the angle of the longitudinal axis relative to the vertical reference axis.

3. The controller of claim 2, in which ink disposed in the ink-receiving chamber defines an ink top surface level, and a desired meniscus level in a nozzle fluidly communicating with the ink-receiving chamber is spaced from the ink top surface level along the longitudinal axis by a distance D1, wherein the processor is further programmed to calculate an effective water column height along the vertical reference axis based on the angle of the longitudinal axis relative to the vertical reference axis and the distance D1, and determine the desired pressure for the control chamber based, at least in part, on the effective water column height.

4. The controller of claim 3, wherein the processor is programmed to determine the desired pressure for the control chamber by subtracting the effective water column height from a predetermined pressure at the desired meniscus level.

5. The controller of claim 1, in which the inkjet assembly further comprises a pressure sensor operably coupled to the control chamber for generating a pressure signal indicative of the actual pressure level in the control chamber, and in which the processor is further operably coupled to the pressure sensor.

6. The controller of claim 1, in which the control fluid source comprises a positive pressure source, fluidly communicating with the control chamber through a first valve, and a negative pressure source, fluidly communicating with the control chamber through a second valve, and in which the processor is operably coupled to the first valve and the second valve.

7. An inkjet printing system, comprising:

an ink reservoir defining an ink-receiving chamber and a control chamber;

a control fluid source fluidly communicating with the control chamber;

an orientation sensor configured to determine an orientation of the ink reservoir and generate an orientation signal; and a processor operably coupled to the control fluid source and the orientation sensor, the processor programmed to:

determine a desired pressure for the control chamber based, at least in part, on the orientation signal; and control the control fluid source to adjust an actual pressure level in the control chamber to the desired pressure for the control chamber.

8. The inkjet printing system of claim 7, in which the ink reservoir defines a longitudinal axis, and in which the orientation sensor is configured to determine an angle of the longitudinal axis relative to a vertical reference axis.

9. The inkjet printing system of claim 8, further comprising a printhead defining a nozzle in fluid communication with the ink-receiving chamber, the nozzle defining a desired meniscus level having a fixed position relative to the ink reservoir.

10. The inkjet printing system of claim 9, in which ink disposed in the ink-receiving chamber defines an ink top surface level, and in which the desired meniscus level of the nozzle is spaced from the ink top surface level along the longitudinal axis of the ink reservoir by a distance D1.

11. The inkjet printing system of claim 10, in which the processor is further programmed to calculate an effective water column height along the vertical reference axis based on the angle of the longitudinal axis relative to the vertical reference axis and the distance D1, and determine the desired pressure for the control chamber based, at least in part, on the effective water column height.

12. The inkjet printing system of claim 11, in which determining the desired pressure for the control chamber comprises subtracting the effective water column height from a predetermined pressure at the desired meniscus level.

13. The inkjet printing system of claim 7, further comprising a pressure sensor operably coupled to the control chamber for generating a pressure signal indicative of the actual pressure level in the control chamber, wherein the processor is further operably coupled to the pressure sensor.

14. The inkjet printing system of claim 7, in which the orientation sensor comprises an accelerometer.

15. The inkjet printing system of claim 7, in which a flexible membrane is disposed between the ink-receiving chamber and the control chamber.

16. The inkjet printing system of claim 7, in which the control fluid source comprises a positive pressure source, fluidly communicating with the control chamber through a first valve, and a negative pressure source, fluidly communicating with the control chamber through a second valve, and in which the processor is operably coupled to the first valve and the second valve.

17. An inkjet printing system having a dynamically controlled ink backpressure, the inkjet printing system comprising:

a frame supported for rotation in at least one degree of freedom relative to a vertical reference axis;

an ink reservoir coupled to the frame and defining a longitudinal axis and comprising a control chamber and an ink-receiving chamber;

a control fluid source fluidly communicating with the control chamber to deliver a control fluid across a range of pressure levels;

an orientation sensor for determining an orientation of the ink reservoir and generating an orientation signal; and a processor operably coupled to the control fluid source and the orientation sensor, the processor programmed to:

determine a desired pressure for the control chamber based, at least in part, on the orientation signal; and control the control fluid source to adjust an actual pressure level in the control chamber to the desired pressure for the control chamber.

18. The inkjet printing system of claim 17, in which the orientation sensor is configured to determine an angle of the longitudinal axis relative to the vertical reference axis, and in which the processor is programmed to determine the desired pressure level for the control chamber based, at least in part, on the angle of the longitudinal axis relative to the vertical reference axis.

19. The inkjet printing system of claim 18, further comprising a nozzle in fluid communication with the ink-receiving chamber, the nozzle defining a desired meniscus level having a fixed position relative to the ink reservoir.

20. The inkjet printing system of claim 19, in which:

ink disposed in the ink-receiving chamber defines an ink top surface level;

the desired meniscus level of the nozzle is spaced from the ink top surface level along the longitudinal axis of the ink reservoir by a distance D1; and the processor is further programmed to calculate an effective water column height along the vertical reference axis based on the angle of the longitudinal axis relative to the vertical reference axis and the distance D1, and determine the desired pressure for the control chamber based, at least in part, on the effective water column height.

* * * * *